US007938704B2

(12) United States Patent
Nomura et al.

(10) Patent No.: US 7,938,704 B2
(45) Date of Patent: May 10, 2011

(54) OUTBOARD MOTOR AND HOOK ASSEMBLY USED FOR OUTBOARD MOTOR

(75) Inventors: Kohei Nomura, Shizuoka (JP); Hiroyuki Hasegawa, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 175 days.

(21) Appl. No.: 12/420,120

(22) Filed: Apr. 8, 2009

(65) Prior Publication Data

US 2009/0258551 A1 Oct. 15, 2009

(30) Foreign Application Priority Data

Apr. 9, 2008 (JP) ..... 2008-100994

(51) Int. Cl.
*B63H 20/32* (2006.01)

(52) U.S. Cl. ..... 440/77; 123/195 P; 292/121

(58) Field of Classification Search ..... 440/76, 440/77, 78; 123/195 P, 195 C; 292/121, 292/128, 129
See application file for complete search history.

(56) References Cited

U.S. PATENT DOCUMENTS

| | | | | |
|---|---|---|---|---|
| 4,875,883 | A * | 10/1989 | Slattery | 440/77 |
| 4,971,587 | A | 11/1990 | Uchida et al. | |
| 5,025,763 | A * | 6/1991 | Watanabe | 440/77 |
| 5,338,236 | A * | 8/1994 | Dunham et al. | 440/77 |
| 5,803,777 | A * | 9/1998 | Hiraoka | 440/77 |
| 6,080,025 | A * | 6/2000 | Isogawa et al. | 440/77 |
| 6,682,379 | B1 * | 1/2004 | Walczak et al. | 440/77 |
| 6,821,170 | B2 * | 11/2004 | Sanschagrin et al. | 440/77 |
| 6,840,827 | B2 * | 1/2005 | Vignau | 440/77 |
| 6,991,500 | B1 * | 1/2006 | Gulko et al. | 440/77 |
| 7,163,428 | B2 * | 1/2007 | Sanschagrin | 440/77 |
| 7,210,973 | B2 * | 5/2007 | Sanschagrin et al. | 440/77 |
| 2005/0186863 | A1 * | 8/2005 | Nakamura | 440/77 |

FOREIGN PATENT DOCUMENTS

JP 02-141390 A 5/1990

* cited by examiner

*Primary Examiner* — Lars A Olson
(74) *Attorney, Agent, or Firm* — Keating & Bennett, LLP

(57) ABSTRACT

A hook assembly is arranged to engage with an engaged member to fix a first housing to a second housing of an outboard motor. The hook assembly includes a rotation shaft, a hook member, a lever, and a weight. The rotation shaft is rotatably mounted on the first housing. A recessed portion is provided in the hook member. The recessed portion is arranged to open in first rotation direction. The recessed portion engages with the engaged member. The lever extends from the rotation shaft in a second rotation direction opposite to the first rotation direction of the recessed portion. The weight regulates the rotation of the hook member in the second rotation direction when the hook member and the engaged member are engaged together. The arrangement provides a highly-operable hook assembly for the outboard motor that prevents disengagement even when an obstacle collides with the outboard motor during traveling of a boat.

11 Claims, 10 Drawing Sheets

OUTBOARD MOTOR AND HOOK ASSEMBLY USED FOR OUTBOARD MOTOR

BACKGROUND OF THE INVENTION

1. Field of the Invention

The present invention relates to an outboard motor and a hook assembly used for the outboard motor.

2. Description of the Related Art

Conventionally, various methods of fixing a bottom cowling and a top cowling have been disclosed. For example, in JP-A-Hei 2-141390, a method for fixing the bottom cowling and the top cowling together using a hook member is proposed.

During traveling of a boat, there could be a case in which an obstacle such as a standing timber collides with an outboard motor. When the obstacle collides with the outboard motor during the traveling of the boat, an outboard motor body is lifted up, so that a force is applied between the top cowling and the bottom cowling in a direction such that the top cowling and the bottom cowling approach each other. This compresses a seal member disposed between the top cowling and the bottom cowling. As a result, the distance between the top cowling and the bottom cowling is shortened. Moreover, an inertia force is generated on a lever arranged to operate a hook member. Consequently, a mere fixing of the bottom cowling and the top cowling via the hook member could cause a rotation of the hook member and could cause the lever to disengage the hook member when the obstacle collides with the outboard motor during the traveling of the boat.

For example, providing a biasing member for urging the hook member in the direction of the engaged state is included as a method to prevent the cancellation of the engaged state of the hook member when the obstacle collides with the outboard motor during the traveling of the boat.

However, by providing the biasing member, a great deal of power is consequently required to operate the lever, which tends to lower the operability of the lever.

SUMMARY OF THE INVENTION

In order to overcome the problems described above, preferred embodiments of the present invention provide a hook assembly for an outboard motor with high operability that prevents the cancellation of an engaged state even when an obstacle collides with the outboard motor during traveling of a boat.

An outboard motor according to a preferred embodiment of the present invention includes a first housing, a second housing, an elastic member, and a hook assembly. The second housing is mounted on the first housing. The second housing includes an engaged member. The elastic member is disposed between the first housing and the second housing. The hook assembly is provided on the first housing. The hook assembly engages with the engaged member to mutually fix the first housing and the second housing. The hook assembly preferably includes a rotation shaft, a hook member, a lever, and a rotation regulating member. The rotation shaft is rotatably mounted on the first housing. The hook member is fixed to the rotation shaft. A recessed portion is provided in the hook member. The recessed portion opens in a first rotation direction. The recessed portion engages with the engaged member. The lever is fixed to the rotation shaft. The lever extends from the rotation shaft in a second rotation direction that is opposite to the first rotation direction of the recessed portion. The rotation regulating member regulates the rotation of the hook member in the second rotation direction when the hook member and the engaged member are engaged with one another.

A hook assembly according to a preferred embodiment of the present invention relates to a hook assembly which is mounted on a first housing of an outboard motor that includes the first housing, a second housing mounted on the first housing and having an engaged member, and an elastic member disposed between the first housing and the second housing such that it engages with the engaged member to mutually fix the first housing and the second housing together.

The hook assembly according to a preferred embodiment of the present invention preferably includes a rotation shaft, a hook member, a lever, and a rotation regulating member. The rotation shaft is rotatably mounted on the first housing. The hook member is fixed on the rotation shaft. A recessed portion is provided in the hook member. The recessed portion opens in a first rotation direction and engages with the engaged member. The lever is fixed on the rotation shaft. The lever extends from the rotation shaft in a second rotation direction opposite to the first rotation direction of the recessed portion. The rotation regulating member regulates the rotation of the hook member in the second rotation direction in a state in which the hook member and the engaged member are engaged with one another.

According to a preferred embodiment of the present invention, it is possible to provide a hook assembly for an outboard motor having high operability and preventing a disengaged state even when an obstacle collides with the outboard motor during traveling of a boat.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

First Preferred Embodiment

Hereinafter, description will be made with respect to preferred embodiments of the present invention with an example of an outboard motor 1 in FIG. 1. However, the preferred embodiments described below are merely exemplary, and the present invention is not limited to the preferred embodiments described below.

Figure 1:
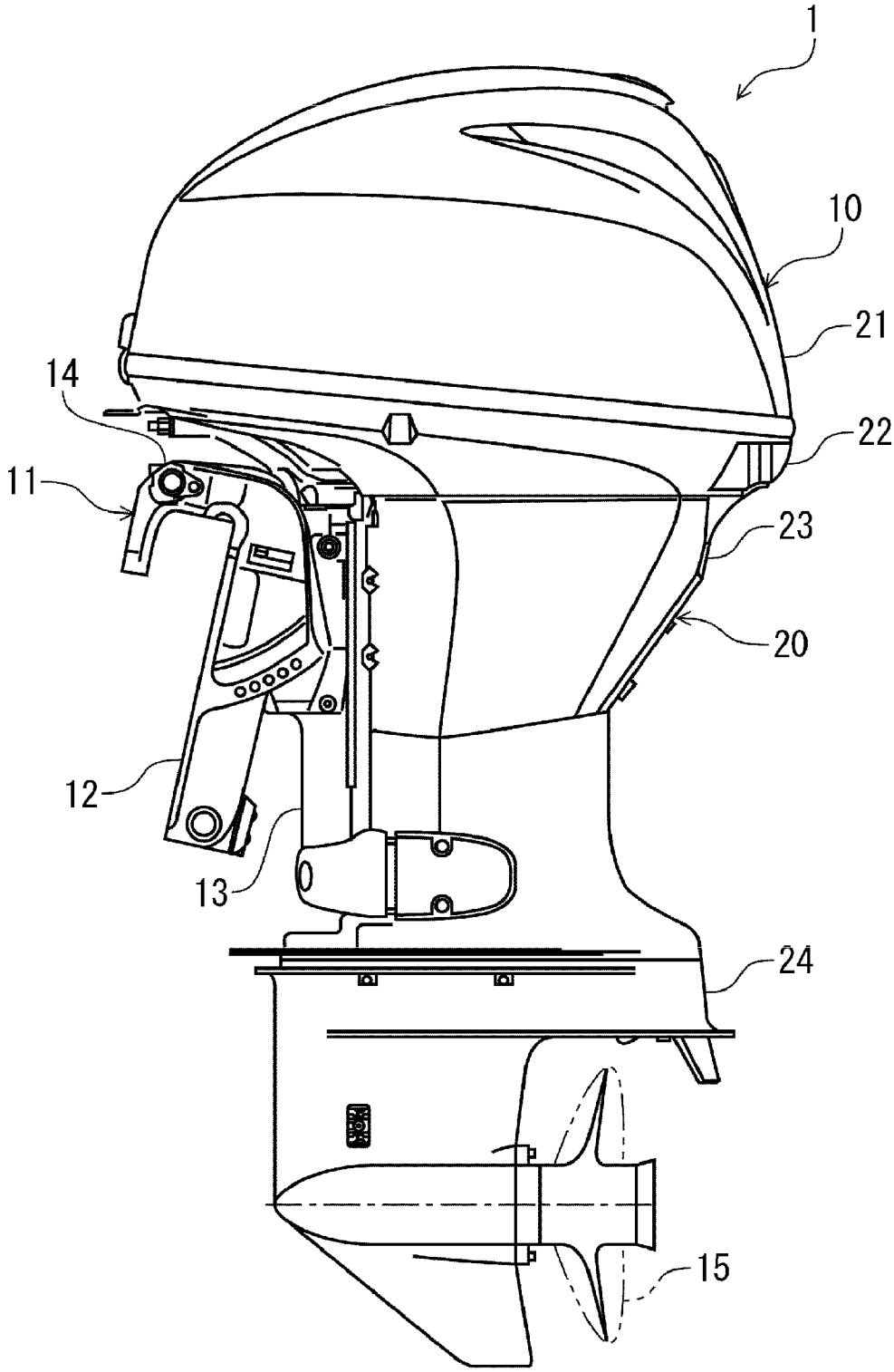
FIG. 1 is a left side view of an outboard motor according to a preferred embodiment of the present invention.

FIG. 1 is a left side view of the outboard motor 1 according to a preferred embodiment. As shown in FIG. 1, the outboard motor 1 includes an outboard motor body 10 and a tilt mechanism 11. The tilt mechanism 11 is arranged to perform tilt and trim operations of the outboard motor body 10.

The tilt mechanism 11 preferably includes a mount bracket 12 and a swivel bracket 13. The mount bracket 12 is fixed to a hull by a bolt or the like. The mount bracket 12 and the swivel bracket 13 are mutually mounted by a swing shaft 14. The swivel bracket 13 is swingable about the axis of the swing shaft 14 with respect to the mount bracket 12. The outboard motor body 10 is mounted on the swivel bracket 13.

The outboard motor body 10 includes a housing 20. A power source, a shift mechanism, and the like (not shown) are housed in the housing 20. The power generated by the power source is transmitted to a propeller 15 shown in FIG. 1. The power source may be an engine or an electric motor, for example.

Figure 8:
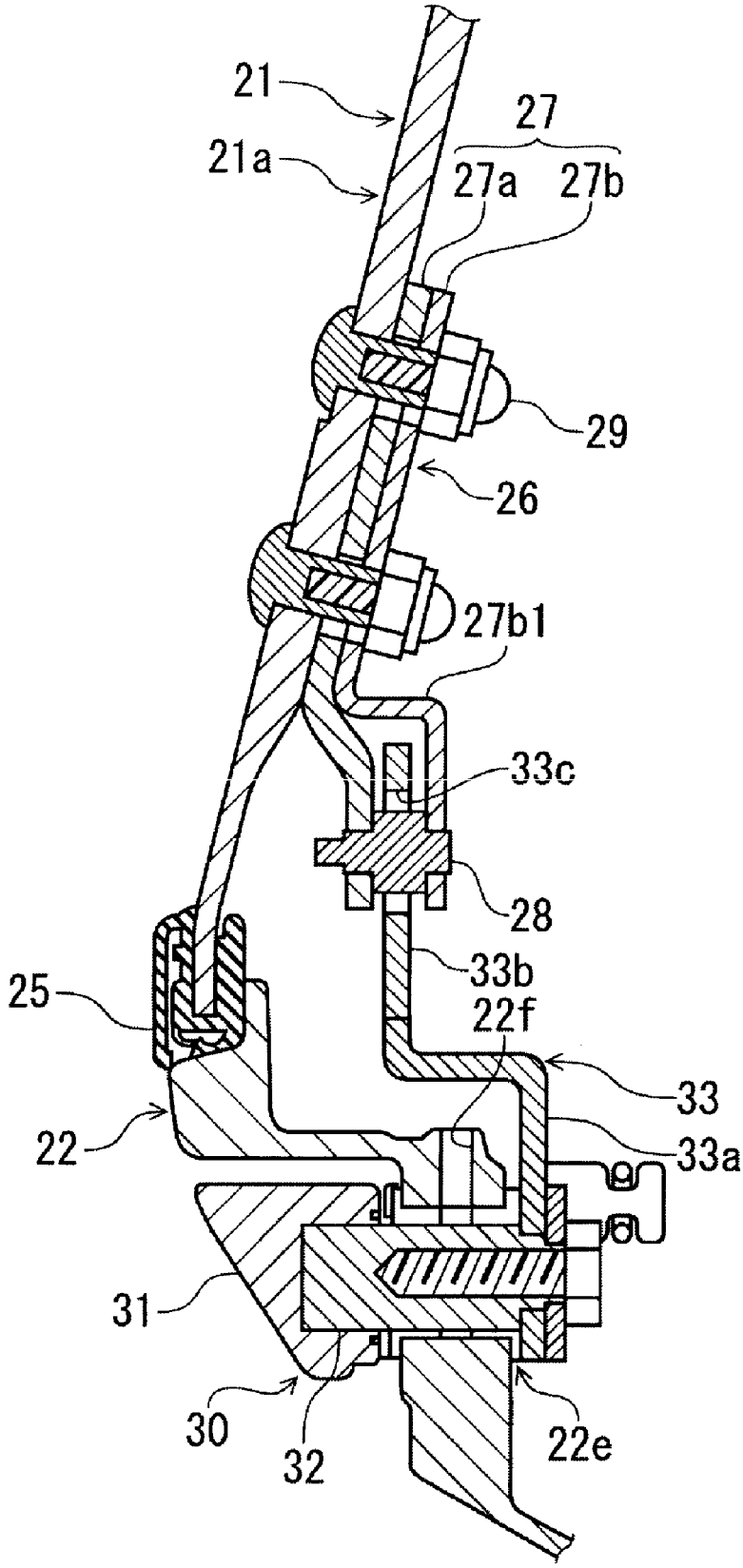
FIG. 8 is a view as seen in the direction of the arrow VIII-VIII in FIG. 6.

The housing 20 includes a top cowling 21 that is a second housing, a bottom cowling 22 that is a first housing, an upper casing 23, and a lower casing 24. The upper casing 23 is disposed on the lower casing 24. The bottom cowling 22 is mounted on the upper casing 23. The top cowling 21 is mounted on the bottom cowling 22. The bottom cowling 22 and the top cowling 21 define a housing space for the power source (not shown). As shown in FIG. 8, a ring-shaped rubber elastic member 25, for example, is disposed on the entire circumference between the bottom cowling 22 and the top cowling 21. The elastic member 25 provides a seal between the bottom cowling 22 and the top cowling 21.

Figure 4:
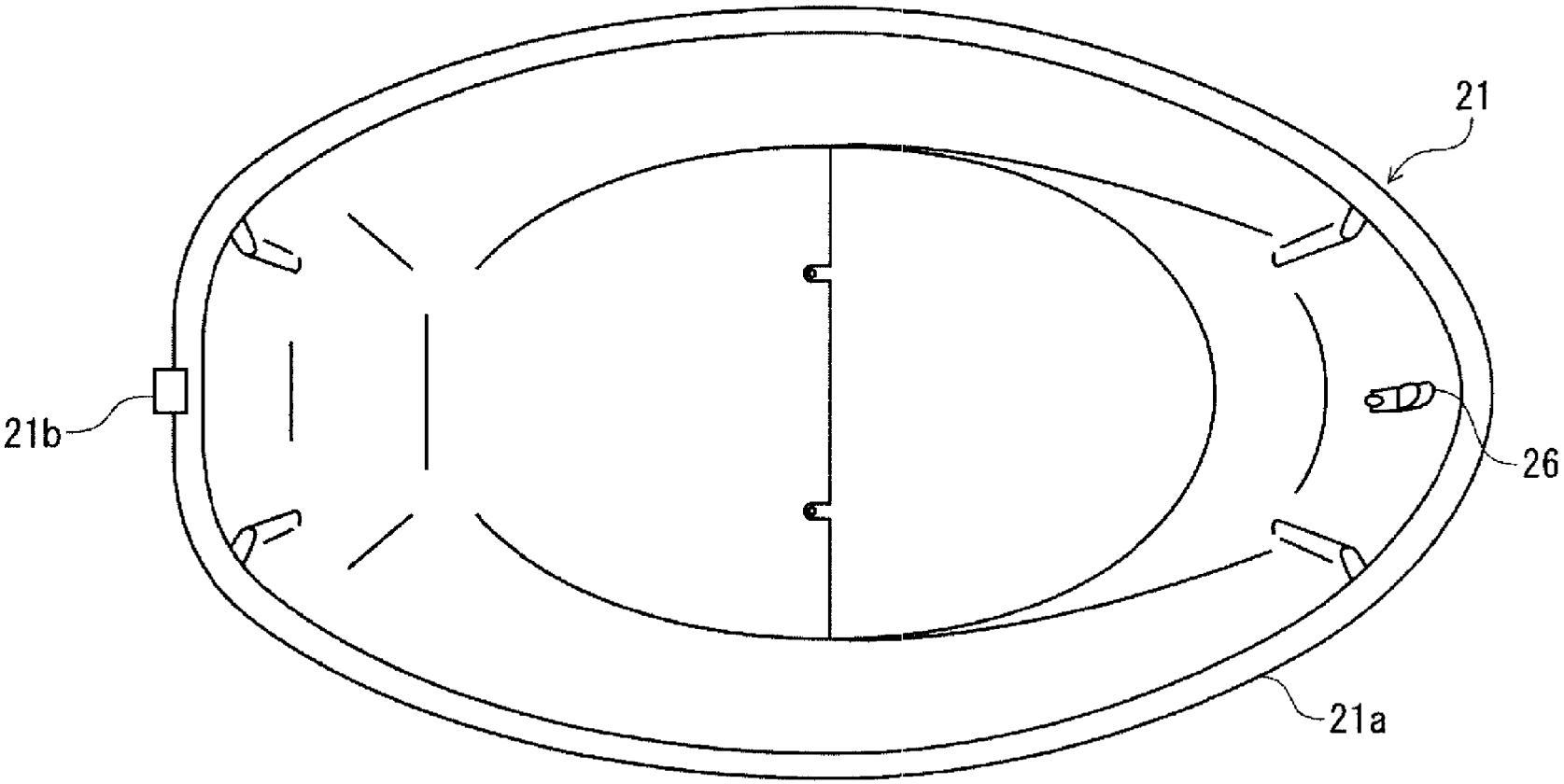
FIG. 4 is a bottom view of the top cowling.

FIG. 4 is a bottom view of the top cowling 21. As shown in FIG. 4, the top cowling 21 includes a cowling body 21*a*. A convex portion 21*b* is defined on the cowling body 21*a*. The convex portion 21*b* is arranged on a front portion of the top cowling 21 and protrudes in a forward direction. On the other hand, a concave portion 22*a* is defined in the bottom cowling 22 shown in FIG. 5. The concave portion 22*a* is arranged on a front portion of the bottom cowling 22. Engagement of the convex portion 21*b* and the concave portion 22*a* allows mutual attachment between the front portion of the top cowling 21 and the front portion of the bottom cowling 22.

Figure 5:
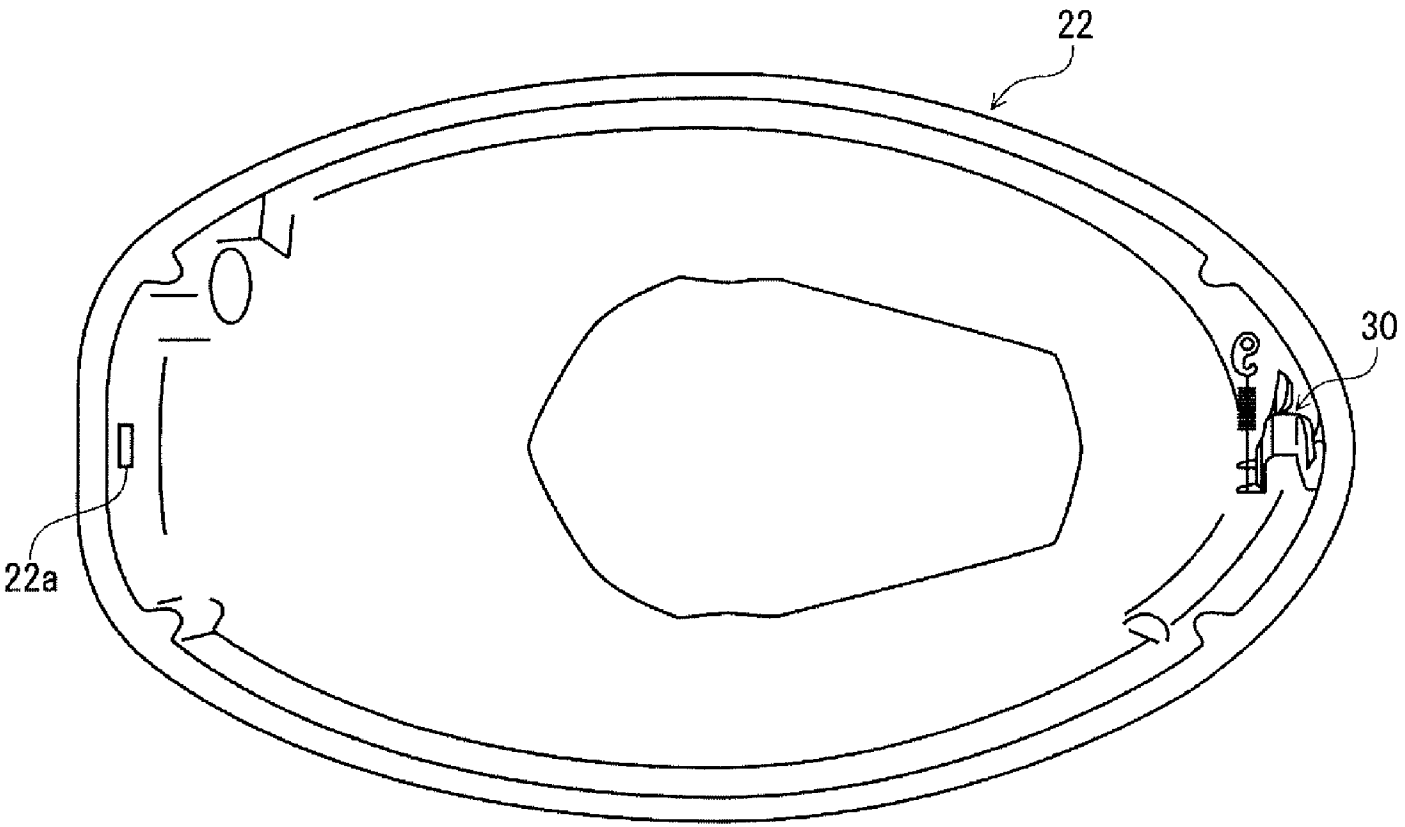
FIG. 5 is a plan view of the bottom cowling.

Moreover, as shown in FIGS. 4 and 8, an engaged member 26 is defined on the cowling body 21*a*. The engaged member 26 is preferably arranged on the inside in a rear portion of the top cowling 21. Meanwhile, as shown in FIGS. 5 and 8, a hook assembly 30 is defined on the bottom cowling 22. Engagement of the hook assembly 30 with the engaged member 26 allows mutual attachment between the rear portion of the top cowling 21 and the rear portion of the bottom cowling 22.

As shown in FIG. 8, the engaged member 26 preferably includes an engaging member body 27 and a bridge member 28. The engaging member body 27 preferably includes a first plate member 27*a* and a second plate member 27*b*. The first plate member 27*a* and the second plate member 27*b* are fixed to the cowling body 21*a* by a bolt 29, for example. A distal portion of the first plate member 27*a* and a distal portion of the second plate member 27*b* are separated from each other. The substantially cylindrical bridge member 28 is bridged between the distal portion of the first plate member 27*a* and the distal portion of the second plate member 27*b*.

Figure 9:
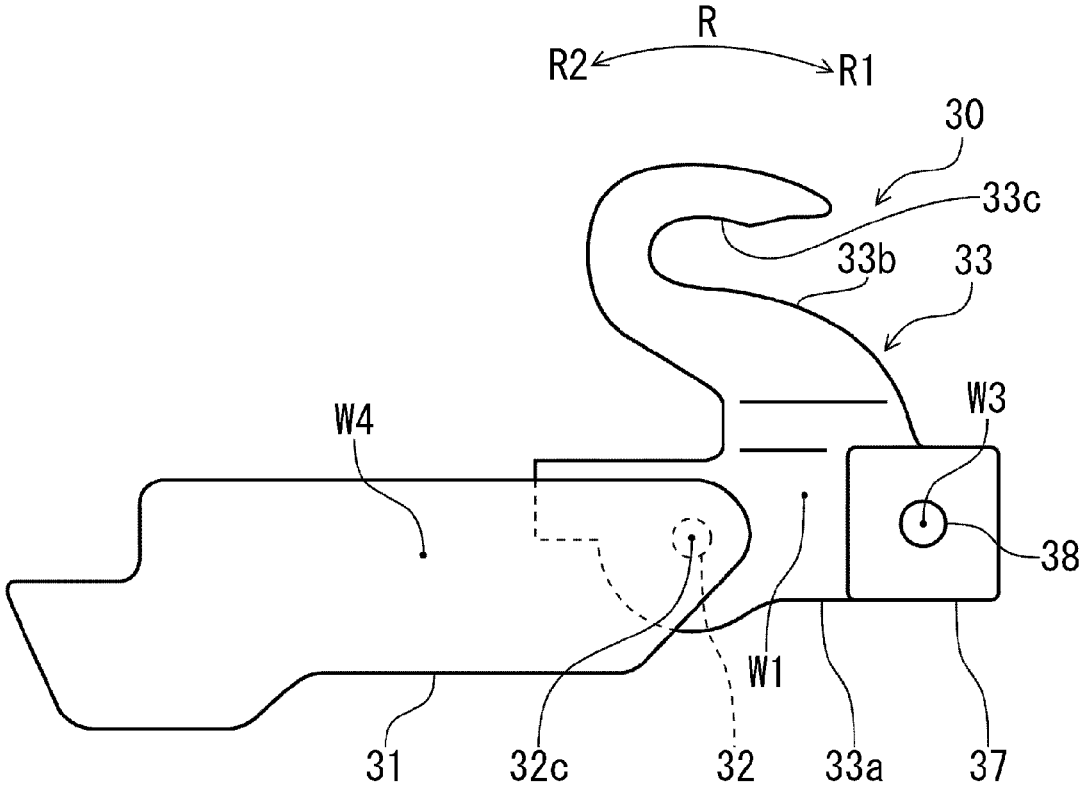
FIG. 9 is a front view of a hook assembly.

As shown in FIG. 9, the hook assembly 30 preferably includes a rotation shaft 32, a hook member 33, a lever 31, and a weight 37 that preferably functions as a rotation regulating member.

As shown in FIG. 8, the rotation shaft 32 is rotatably mounted to the bottom cowling 22. The hook member 33 is fixed to an inner end of the rotation shaft 32. As shown in FIG. 9, the hook member 33 includes a hook member body 33*a* and an engaging portion 33*b*. The hook member body 33*a* is fixed to the rotation shaft 32. The hook member body 33*a* is partially positioned on the opposite side from the lever 31 with respect to the rotation shaft 32.

The engaging portion 33*b* is connected with the hook member body 33*a*. A recessed portion 33*c* is provided in the engaging portion 33*b*. The recessed portion 33*c* is opened toward one side R1 of the rotation direction R. The recessed portion 33*c* engages or disengages the bridge member 28 of the engaged member 26 by a rotation of the engaging portion 33*b* about the rotation shaft 32.

As shown in FIG. 8, the lever 31 is preferably fixed to an outer end of the rotation shaft 32. The lever 31 is disposed on the outside of the bottom cowling 22. As shown in FIG. 9, the lever 31 extends from the rotation shaft 32 to the other side R2 which is opposite from the opening direction of the recessed portion 33*c*.

Figure 6:
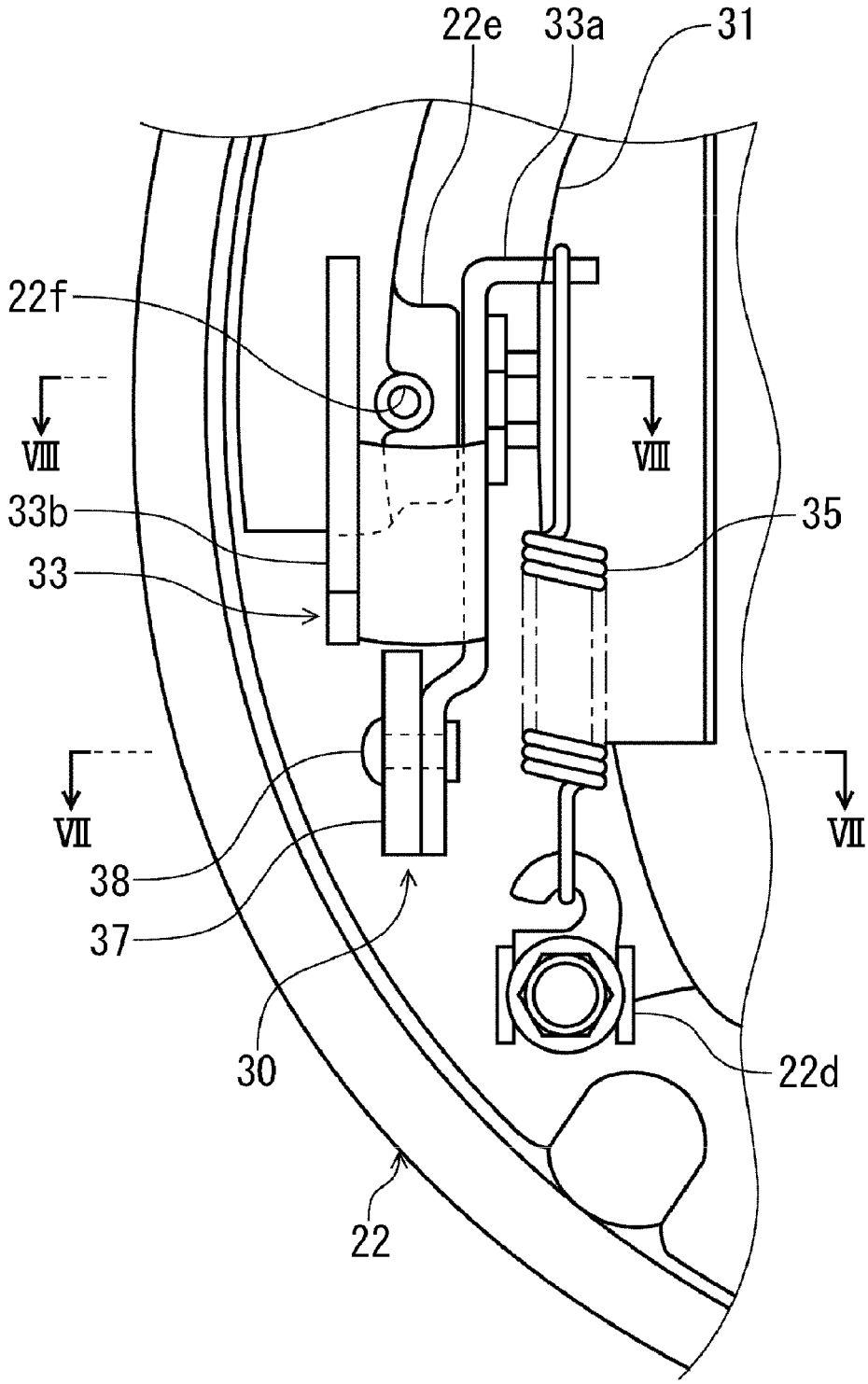
FIG. 6 is a partially enlarged plan view of the bottom cowling.

As shown in FIG. 6, one end of a tension coil spring 35, which is arranged as a biasing member, is mounted on the hook member 33. The other end of the tension coil spring 35 is arranged on a fixing portion 22*d* provided on the bottom cowling 22. The tension coil spring 35 urges the hook member 33 to the opposite direction from the opening direction of the recessed portion 33*c* in a state such that the hook member 33 and the engaged member 26 are engaged together.

Figure 7:
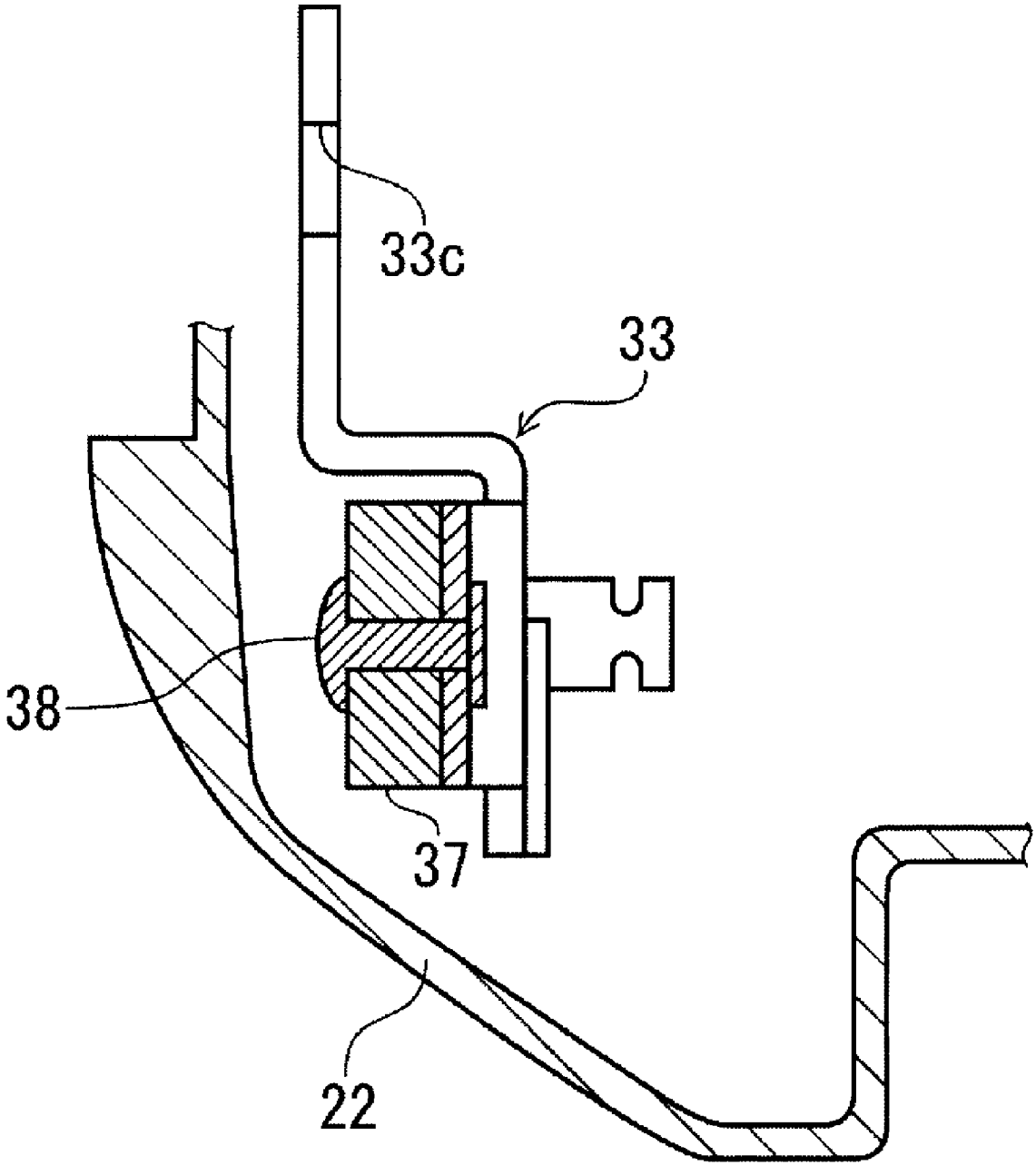
FIG. 7 is a view as seen in the direction of the arrow VII-VII in FIG. 6.

As shown in FIG. 9, in the present preferred embodiment, the weight 37, which is arranged as a rotation regulating member, is fixed on a portion of the hook member body 33*a* that is on the opposite side of the rotation shaft 32 from the lever 31. That is, the weight 37 is positioned on the side of the opening direction R1 of the recessed portion 33*c* with respect to the axis 32*c* of the rotation shaft 32. The center of gravity of the weight 37 is positioned on the side of the rotation direction R1 with respect to the axis 32*c* of the rotation shaft 32 in a state in which the hook member 33 and the engaged member 26 are engaged. Additionally, as shown in FIGS. 7 and 9, the weight 37 is fixed by a rivet 38, for example.

The weight 37 is arranged to set the center of gravity of the hook assembly 30 in a position equal to the axis 32*c* of the rotation shaft 32 or on the side closer to the opening direction R1 of the recessed portion 33*c* from the axis 32*c* of the rotation shaft 32 in a state where the hook member 33 and the engaged member 26 are engaged. More specifically, as shown in FIG. 9, in the present preferred embodiment, the center of gravity W1 of the hook assembly 30 is positioned on the side closer to the opening direction R1 of the recessed portion 33*c* from the axis 32*c* of the rotation shaft 32.

Additionally, as shown in FIG. 9, in the present preferred embodiment, the center of gravity W3 of the weight 37, the axis 32*c* of the rotation shaft 32, and the center of gravity W4 of the lever 31 are aligned substantially linearly.

As shown in FIG. 8, an oil supply hole 22f is provided in a mounting portion 22*e* of the bottom cowling 22 of the hook assembly 30. The oil supply hole 22*f* opens up to the rotation shaft 32 and extends in an upward direction. Lubrication oil is preferably supplied from the oil supply hole 22*f* to a portion between the mounting portion 22*e* and the rotation shaft 32.

Figure 2:
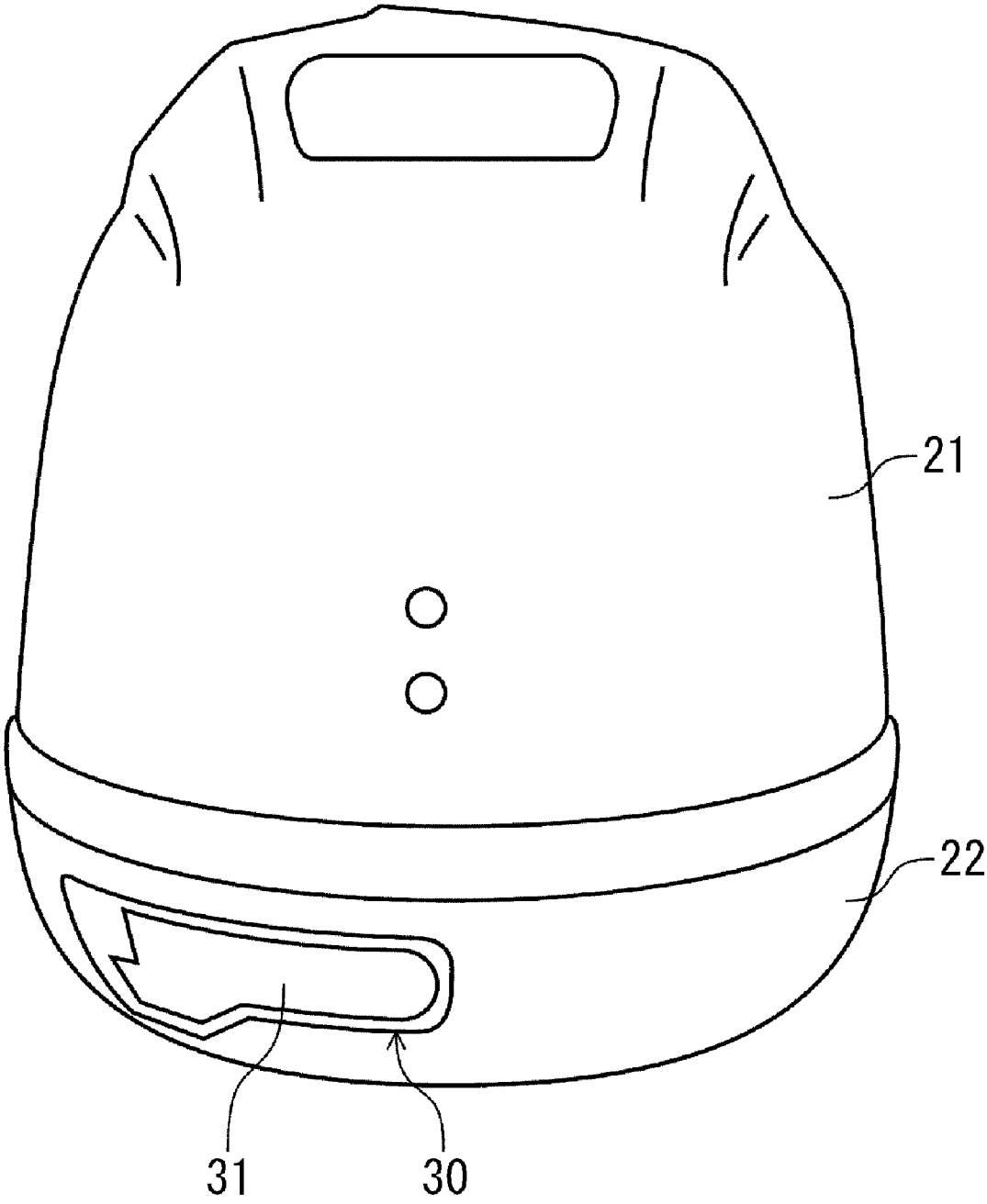
FIG. 2 is a rear view of a top cowling and a bottom cowling in an engaged state.

Next, an engagement and disengagement procedure of the bottom cowling 22 with/from the top cowling 21 will be explained. When the top cowling 21 is mounted on the bottom cowling 22, initially, the convex portion 21*b* is engaged with the concave portion 22*a*. Then, the top cowling 21 and the bottom cowling 22 are butted together in a state such that the lever 31 is rotated to a position shown in FIG. 3. Thereafter, as shown in FIG. 2, the lever 31 is operated to be horizontal. This allows an engagement between the hook member 33 and the engaged member 26, so that the top cowling 21 is fixed to the bottom cowling 22 as shown in FIG. 8.

Figure 3:
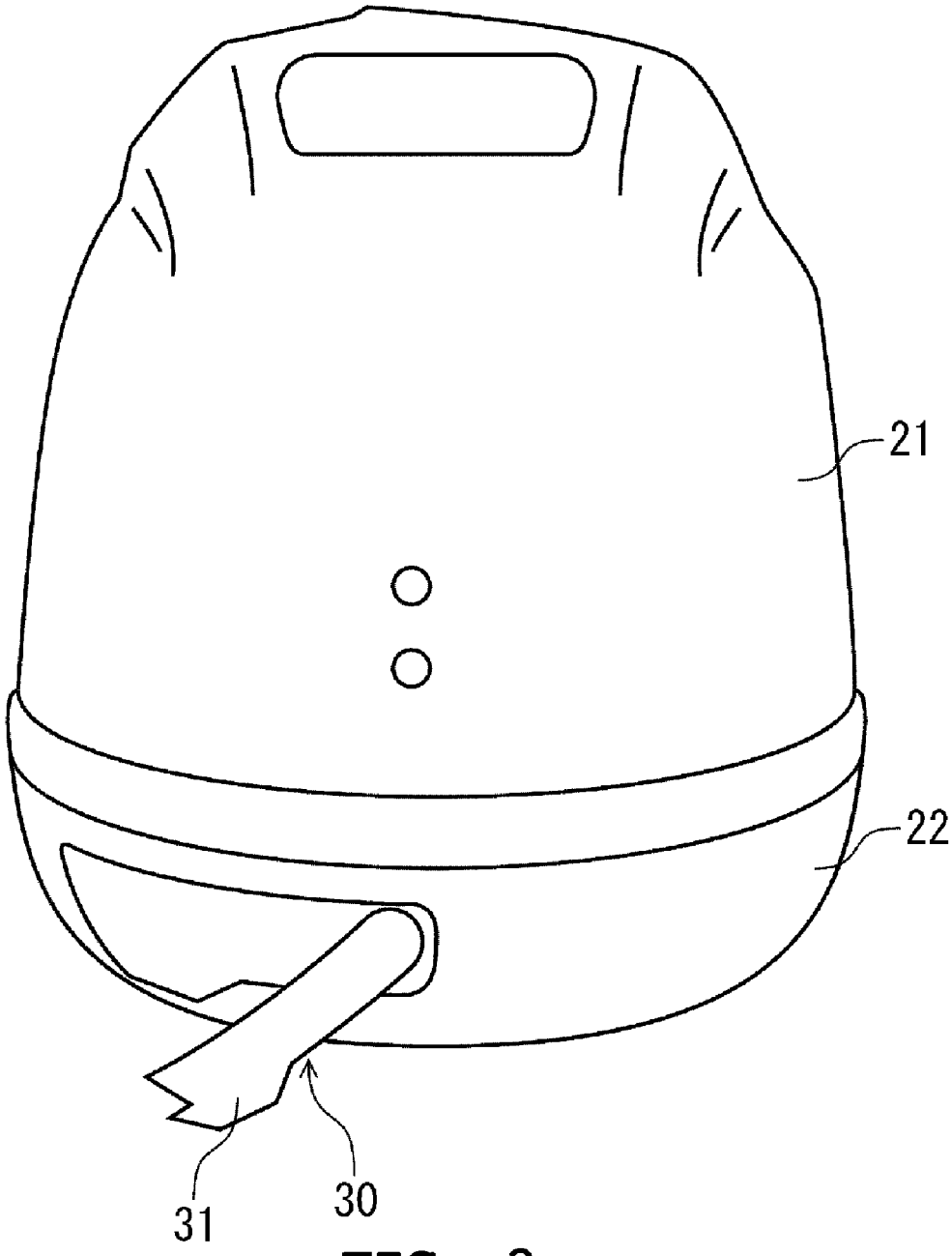
FIG. 3 is a rear view of the top cowling and the bottom cowling in a disengaged state.

When the top cowling 21 is separated from the bottom cowling 22, the lever 31 is operated to move to a position shown in FIG. 3. This eliminates the engagement between the hook member 33 and the engaged member 26. As a result, the top cowling 21 is removable from the bottom cowling 22.

As described above, in the present preferred embodiment, the weight 37 as the rotation regulating member is provided as shown in FIG. 9. Accordingly, the center of gravity W1 of the hook assembly 30 is positioned on the side closer to the opening direction R1 of the recessed portion 33*c* with respect to axis 32*c* of the rotation shaft 32. Consequently, the direction of the inertia force acting on the hook assembly 30 is the opening direction R1 when an obstacle such as a standing timber, for example, collides with either of the upper casing 23 or the lower casing 24. This collision applies a rearward force to either the upper casing 23 or the lower casing 24, and thus rotation of the hook assembly 30 in the direction R2 can be prevented even when the engaging portion 33*b* and the bridge member 28 are separated from each other. As a result, disengagement of the hook assembly 30 and the engaged member 26 can be prevented. This prevents separation of the top cowling 21 from the bottom cowling 22 when the obstacle such as a standing timber collides with the upper casing 23 or the lower casing 24.

Additionally, in the present preferred embodiment, a description has been made of a case in which the center of gravity W1 of the hook assembly 30 is preferably positioned on the side closer to the opening direction R1 of the recessed portion 33*c* with respect to the axis 32*c* of the rotation shaft 32. However, the center of gravity W1 may be positioned adjacent to the axis 32*c* of the rotation shaft 32. In a case where the center of gravity W1 is positioned adjacent to the axis 32*c*, the inertia force acting on the hook assembly 30 is not so large when the obstacle, such as a standing timber, collides with either the upper casing 23 or the lower casing 24. Accordingly, in the similar manner, separation of the top cowling 21 from the bottom cowling 22 can be prevented.

Incidentally, for example, even when the center of gravity of the weight, the axis of the rotation shaft, and the center of gravity of the lever are not linearly aligned when seen from the extending direction of the axis of the rotation shaft 32, the balance of the hook assembly is maintained as long as the lever is in a horizontal or substantially horizontal state. Therefore, rotation of the hook assembly can be prevented. However, in such a case, if the hook assembly is rotated even slightly, and thus the lever is no longer in a horizontal position, the balance of the hook assembly tends to become disproportionate, so that the hook assembly tends to easily rotate.

On the other hand, in the present preferred embodiment, the center of gravity W3 of the weight 37, the axis 32*c* of the rotation shaft 32, and the center of gravity W4 of the lever 31 are aligned substantially linearly as seen from the extending direction of the axis 32*c* of the rotation shaft 32 as shown in FIG. 9. This prevents a disproportionate condition in the balancing state of the hook assembly 30 even when the hook assembly 30 rotates and the lever 31 is not in a horizontal or substantially horizontal state. Accordingly, the rotation of the hook assembly 30 can be more effectively prevented by aligning the center of gravity W3, the axis 32*c*, and the center of gravity W4 substantially in a linear manner, as seen from the extending direction of the axis 32*c* as in the present preferred embodiment.

Incidentally, even when the center of gravity of the hook assembly is positioned on the side closer to the lever from the axis of the rotation shaft in a state in which the hook assembly engages with the engaged member, it is conceivable to prevent the cancellation of an engaged state between the hook assembly and the engaged member by providing a biasing member arranged to strongly urge the hook assembly in the direction R1 shown in FIG. 9. However, in such a case, a great deal of power is required to operate the hook assembly. Accordingly, the operability of the hook assembly tends to be lowered.

On the other hand, in the present preferred embodiment, providing a biasing device that applies a strong biasing force is unnecessary. This achieves easy operability of the hook assembly 30.

However, even when the center of gravity W1 in a state in which the hook assembly 30 engages with the engaged member 26 is positioned on the side closer to the direction R1 with respect to the axis 32*c*, it is preferable to provide a tension coil spring 35 that applies a relatively small biasing force that has no influence on the operation of the hook assembly 30. This effectively prevents the top cowling 21 from being separated from the bottom cowling 22.

The fixing method of the weight 37 is not particularly limited. The weight 37 may be fixed to the hook member 33 by welding, for example. Alternatively, the weight 37 may be fixed to the hook member 33 by a screw, for example. However, it is more preferable that the weight 37 be fixed to the hook member 33 by the rivet 38 as in the present preferred embodiment. This is because the weight 37 can be strongly fixed and separation of the weight 37 from the hook member 33 can be more reliably prevented.

In the present preferred embodiment, the oil supply hole 22*f* is preferably arranged to extend upward. This allows the easy supply of the lubrication oil to a portion between the rotation shaft 32 and the mounting portion 22*e* in a state in which the lever 31 is horizontal.

Second Preferred Embodiment

In the first preferred embodiment, a description has been provided of an example in which the weight 37 preferably defines a rotation regulating member. However, the rotation regulating member is not limited to the weight 37. That is, the rotation regulating member does not have to be a member that moves the center of gravity of the hook assembly to the side of the opening direction R1.

For example, the rotation regulating member may be a member that applies a reaction force in the rotation direction R1 to the hook member when the hook assembly attempts to move in the rotation direction R2. In the present preferred embodiment, a description will be made of an example where the rotation regulating member is a member that applies the reaction force in the rotation direction R1 to the hook member when the hook assembly attempts to move in the rotation direction R2. Additionally, in the description below, members that have substantially the same functions as those in the first preferred embodiment are denoted by the same reference numerals, and their descriptions are omitted. Moreover, FIG. 8 is referred in common with the first preferred embodiment.

Figure 10:
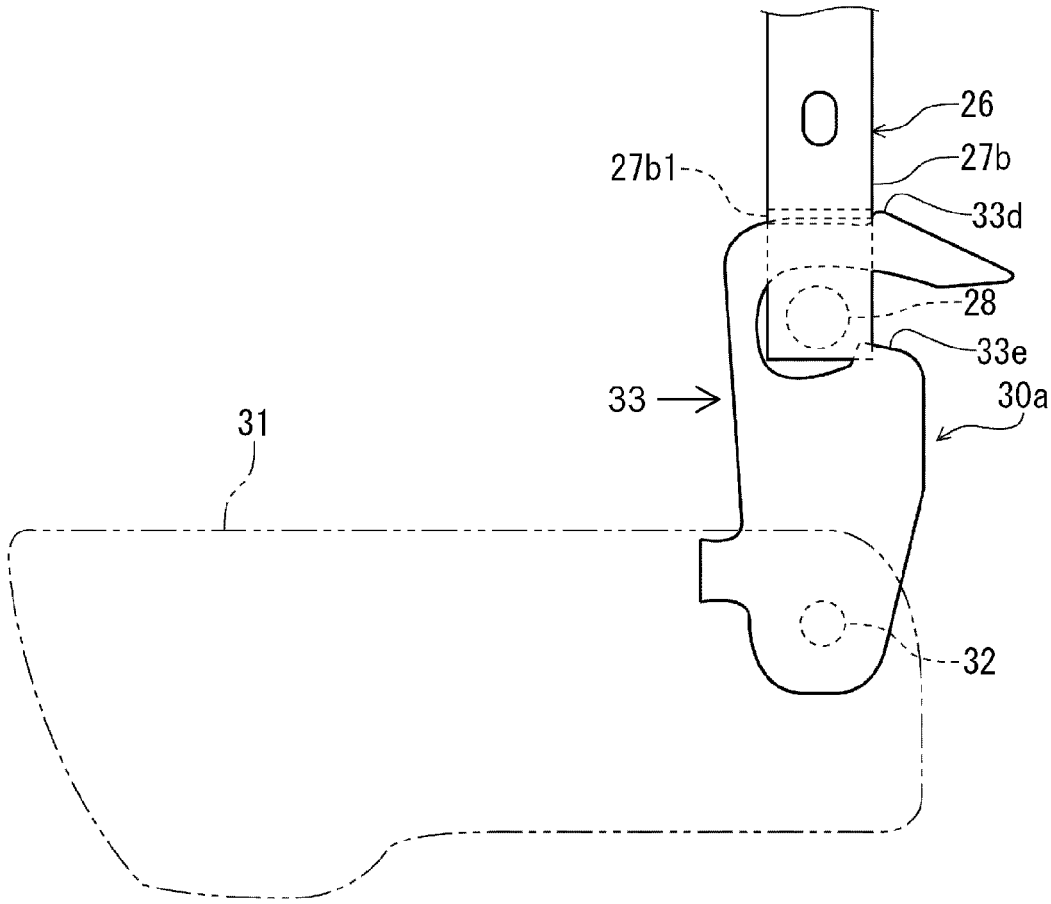
FIG. 10 is a front view of a hook assembly in a preferred embodiment of the present invention.

As shown in FIG. 10, in the present preferred embodiment, a first protrusion 33*d* and a second protrusion 33*e* arranged as rotation regulating members are defined in the engaging portion 33*b*. The first protrusion 33*d* and the second protrusion 33*e* are preferably positioned on a side closer to the opening direction of the recessed portion 33*c* from the engaged member 26 in a state such that the hook member 33 and the engaged member 26 are engaged. The first protrusion 33*d* and the second protrusion 33*e* protrude in the radial direction from the hook member 33.

Because of this, as shown in FIG. 10, when the hook assembly 30*a* moves to the side of the engaged member 26, the first protrusion 33*d* engages with a horizontal portion 27*b*1 of the second plate member 27*b*. Moreover, the second protrusion 33*e* engages with the bridge member 28. Accordingly, when the hook assembly attempts to move in the rotation direction R2, in the first protrusion 33*d* and the second protrusion 33*e*, the reaction force in the rotation direction R1 acts on the engaging portion 33*b*. This prevents rotation of the hook assembly 30*a* in the direction opposite from the opening direction of the recessed portion 33*c*, so that a disengagement between the hook assembly 30*a* and the engaged portion 26 is prevented. As a result, separation of the top cowling 21 from the bottom cowling 22 can be prevented.

Additionally, only either the first protrusion 33*d* or the second protrusion 33*e* may be provided. Moreover, at least either the first protrusion 33*d* or the second protrusion 33*e* and the weight 37 in the first preferred embodiment may be provided.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An outboard motor comprising:

a first housing;

a second housing mounted on the first housing and including an engaged member;

an elastic member disposed between the first housing and the second housing; and a hook assembly provided on the first housing and arranged to engage the engaged member to attach the first housing and the second housing together; wherein the hook assembly includes:

a rotation shaft rotatably mounted on the first housing;

a hook member on the rotation shaft and defining a recessed portion that opens in a first direction to engage with the engaged member;

a lever on the rotation shaft and arranged to extend from the rotation shaft in a second direction that is opposite to the first direction of the recessed portion; and a rotation regulating member arranged to regulate the rotation of the hook member in a direction opposite to the first direction when the hook member and the engaged member are engaged together.

2. The outboard motor according to claim 1, wherein the rotation regulating member is arranged to set a center of gravity of the hook assembly at a position that is located substantially along an axis of the rotation shaft or on a side of the opening direction of the recessed portion relative to the axis of the rotation shaft when the hook member and the engaged member are engaged together.

3. The outboard motor according to claim 1, wherein a center of gravity of the hook assembly is positioned on a peripheral portion of an axis of the rotation shaft as seen from an axial direction of the rotation shaft when the hook member and the engaged member are engaged together.

4. The outboard motor according to claim 1, wherein the rotation regulating member includes a weight having a center of gravity positioned on a side adjacent to the opening direction of the recessed portion relative to an axis of the rotation shaft.

5. The outboard motor according to claim 4, wherein the center of gravity of the weight, an axis of the rotation shaft, and a center of gravity of the lever are substantially linearly aligned when seen from an extending direction of the axis of the rotation shaft.

6. The outboard motor according to claim 4, wherein the hook assembly includes a rivet arranged to attach the weight and the hook member together.

7. The outboard motor according to claim 1, wherein the rotation regulating member includes a protruding portion in a portion of the hook member positioned on a side of the opening direction of the recessed portion relative to the engaged member, and the protruding portion is arranged to protrude in a radial direction from the hook member such that the hook member and the engaged member are engaged together.

8. The outboard motor according to claim 1, wherein the hook assembly includes a biasing member including one end mounted on the first housing and arranged to urge the hook member in the direction opposite from the opening direction of the recessed portion when the hook member and the engaged member are engaged together.

9. The outboard motor according to claim 1, wherein the opening direction of the recessed portion is a substantially horizontal direction when the hook member and the engaged member are engaged; and an oil supply hole arranged to be opened to the rotation shaft and extending upward from the rotation shaft is arranged on a mounting portion of the first housing of the hook assembly.

10. The outboard motor according to claim 1, further comprising:

an outboard motor body including the first housing and the second housing;

a mount bracket arranged to be fixed to a hull; and a swivel bracket which is supported by the mount bracket to swing about the axis of a swing shaft in the vertical direction, and on which the outboard motor body is mounted.

11. A hook assembly arranged to be mounted on a first housing of an outboard motor which includes the first housing, a second housing mounted on the first housing and having an engaged member, and an elastic member disposed between the first housing and the second housing, and arranged to engage with the engaged member to mutually attach the first housing and the second housing together, the hook assembly comprising:

a rotation shaft arranged to be rotatably mounted on the first housing;

a hook member fixed on the rotation shaft and defining a recessed portion that opens in a first direction to engage with the engaged member;

a lever on the rotation shaft and extending from the rotation shaft in a second direction that is opposite to the first direction of the recessed portion; and a rotation regulating member arranged to regulate rotation of the hook member in a direction opposite to the first direction such that the hook member and the engaged member are engaged together.

* * * * *